US007258606B1

(12) United States Patent
Reid

(10) Patent No.: US 7,258,606 B1
(45) Date of Patent: Aug. 21, 2007

(54) MODULAR RETROFIT HEATING, VENTILATING AND AIR CONDITIONING SYSTEM

(76) Inventor: Carlos Patrick Reid, 1714 Highway 80 West, Demopolis, AL (US) 36732

( * ) Notice: Subject to any disclaimer, the term of this patent is extended or adjusted under 35 U.S.C. 154(b) by 141 days.

(21) Appl. No.: 11/220,153

(22) Filed: Sep. 6, 2005

(51) Int. Cl.
*F24F 7/013* (2006.01)
*F24F 13/20* (2006.01)

(52) U.S. Cl. ..... 454/204; 454/201; 454/330; 62/262; 312/101

(58) Field of Classification Search ..... 454/196, 454/203, 204, 330, 201, 270, 271; 62/262, 62/263, 298, 335; 312/101; 248/208; 392/372, 392/358
See application file for complete search history.

(56) References Cited

U.S. PATENT DOCUMENTS 1,916,907 A * 7/1933 Sargent ..... 165/48.1
2,062,042 A * 11/1936 Sargent ..... 165/48.1
2,746,826 A * 5/1956 Cahn ..... 312/101
3,012,762 A 12/1961 Norris ..... 257/295
3,411,569 A 11/1968 Hildreth ..... 165/63
3,974,661 A * 8/1976 Ferdelman et al. ..... 62/262
4,573,328 A * 3/1986 Bolton et al. ..... 62/263
4,644,135 A * 2/1987 Daily ..... 392/363
4,687,050 A * 8/1987 Podlipnik ..... 165/255
4,828,171 A 5/1989 Akin, Jr. et al. ..... 237/19
4,977,750 A 12/1990 Metcalfe ..... 62/77
5,135,413 A * 8/1992 Pannizzo ..... 439/577
5,277,036 A 1/1994 Dieckmann et al. ..... 62/69
5,335,721 A 8/1994 Wollaber et al. ..... 165/122
5,485,878 A 1/1996 Derks ..... 165/16
6,230,510 B1 * 5/2001 Price ..... 62/263
6,662,588 B2 12/2003 Houk et al. ..... 62/298
6,845,918 B2 * 1/2005 Rotondo ..... 236/46 R
2002/0007593 A1 * 1/2002 Mischo ..... 47/86
2003/0029184 A1 * 2/2003 Ohama et al. ..... 62/262
2003/0106701 A1 * 6/2003 Riner ..... 174/48
2004/0094289 A1 5/2004 Harshberger et al. ..... 165/48.1

FOREIGN PATENT DOCUMENTS

JP 06050563 A * 2/1994

* cited by examiner

*Primary Examiner*—Kenneth Rinehart
*Assistant Examiner*—Patrick F O'Reilly, III
(74) *Attorney, Agent, or Firm*—C. Brandon Browning; Sirote & Permutt P.C.

(57) ABSTRACT

A modular heating, ventilation and air conditioning system including a rectangular sleeve that can be secured through an exterior wall of a building for moving air between an exterior of the building and the interior of the building, an electrical outlet fitted with an electrical outlet adapter pan that connects the outlet within the sleeve, a through-wall air conditioning unit fitted with an air conditioning adapter collar that connects the air conditioning unit within the sleeve, a heater unit fitted with a heater unit adapter pan that connects the heater unit within the sleeve and an electrical system control module including a thermostat and control pad assembly, a first switch and a second switch that selectively activates the sockets of the outlet.

11 Claims, 8 Drawing Sheets

MODULAR RETROFIT HEATING, VENTILATING AND AIR CONDITIONING SYSTEM

FIELD OF THE INVENTION

The present invention relates to a heating, ventilating and air conditioning (HVAC) system and more particularly to a modular HVAC system for retrofitting a sleeve of an inoperable through-wall air conditioning and heating unit with a heating unit, a cooling unit, an electrical outlet and an electrical control unit, each of the added units being independently attached within and independently removable from the sleeve.

BACKGROUND OF THE INVENTION

Through-wall HVAC units are commonly used in motels, hotels, hospitals and commercial buildings for providing climate control. Typically, these units include a rectangular sleeve that extends through an exterior wall of a building and a single, massive integrated air cooling (AC) unit and heating unit assembly housed within the sleeve. The AC portion of the such assemblies must project on both sides of the wall with an evaporator on the inside of the wall and the condenser coil on the outside of the wall. If either one of the AC unit or heating unit fails or is damaged, the entire assembly must be replaced. This makes the repair and replacement of through-wall HVAC units costly.

The size of through-wall HVAC units also makes their maintenance costly. For example, the common commercial through-wall HVAC unit is 16 inches tall, 42 inches long and 14 inches deep. The large size of the unit usually requires at least two repairmen to remove the integrated AC unit and heating unit assembly from the sleeve so that it can be cleaned of bacteria and mold.

The shortcomings of prior art through-wall HVAC units can be avoided by replacing the single, massive integrated AC unit and heating unit assembly housed within a sleeve with independently connectable and removable modules tailored to fit within existing through-wall type sleeves.

OBJECTS AND SUMMARY OF THE INVENTION

A primary object of the invention is to provide a modular, through-wall heating, ventilating and air conditioning system including a number of modules, with each of the modules being independently connectable within and removable from the sleeve and selected from a heating module, a cooling module, an electrical outlet module and a control module.

A further primary object of the invention is to provide a method of retrofitting a sleeve of a damaged or otherwise inoperable integrated AC and heating assembly with a number of modules, with each of the modules being independently connectable within and removable from the sleeve and selected from a heating module, a cooling module, an electrical outlet module and a control module.

A further object of the invention is to provide a kit for retrofitting a through-wall integrated AC and heating assembly sleeve with an independently replaceable AC module, an independently replaceable heating module, an independently replaceable electrical outlet module and an independently replaceable control module.

Another object of the invention is to provide an adapter for detachably connecting each of a through-wall air conditioner, a heater, an electrical outlet and, optionally a thermostat and control pad assembly with a sleeve of a damaged or otherwise inoperable integrated AC and heating assembly.

The objects of the invention are accomplished by providing a rectangular sleeve that can be secured through an exterior wall of a building for moving air between an exterior of the building and the interior of the building. Detachably connected within a passageway defined by the sleeve are a household electrical outlet fitted with an electrical outlet adapter pan for connecting the outlet with the sleeve, a through-wall air conditioning unit fitted with an air conditioning adapter collar for connecting the air conditioning unit within the sleeve and a heater unit fitted with a heater unit adapter pan for connecting the heater unit within the sleeve. In addition, an electrical system control module can be provided that is connected with the electrical outlet for selectively activating the electrical sockets of the outlet.

A further embodiment of the present invention is a method of retrofitting a damaged integrated through-wall air conditioning and heating unit. According to the method, an integrated heating and cooling assembly of a through-wall AC and heating unit is removed from the unit's sleeve and replaced by individual, independently connectable and removable heating, cooling and electrical outlet modules. Each of the modules is fitted with an individually tailored adapter that allows each respective module to be detachably connected within the sleeve. The electrical outlet adapter pan includes an open front, a closed back, a continuous sidewall extending between the open front and closed back and a flange extending along a length of an edge of the continuous sidewall for engaging the sleeve. Similarly, the heater unit adapter pan includes an open front, a closed back, a continuous sidewall extending between the open front and closed back and a flange extending along a length of an edge of the continuous sidewall for engaging the sleeve. A hole can be included in the closed back of each of the heating unit adapter and the outlet adapter to allow wiring and the like to exit. The air conditioning adapter collar includes an open front, an open back, a continuous sidewall extending between the open front and open back and a flange extending along a length of an edge of the continuous sidewall for engaging the sleeve. Preferably, a control unit is electrically connected with the electrical outlet module for independently electrifying the sockets of the modules.

Another embodiment of the present invention is a kit for retrofitting a through-wall integrated air conditioning and heating unit sleeve with individual, independently replaceable air conditioning modules, including a heating module, a cooling module and an electrical outlet module. As part of the kit there are provided individually tailored adapters for detachably connecting the modules within the sleeve. Thus, there are provided an electrical outlet adapter pan for connecting the outlet within an opening in the sleeve, an air cooling unit adapter collar for connecting the air cooling unit within the opening of the sleeve and a heater unit adapter pan for connecting the heater unit within the opening of the front panel of the sleeve. Preferably, an electrical control system module is included in the kit, the control module including, among other things, a thermostat and control pad for selecting the desired room temperature and a pair of switches selectively activated by the thermostat and control pad.

DETAILED DESCRIPTION OF PRESENTLY PREFERRED EMBODIMENTS

Figure 1:
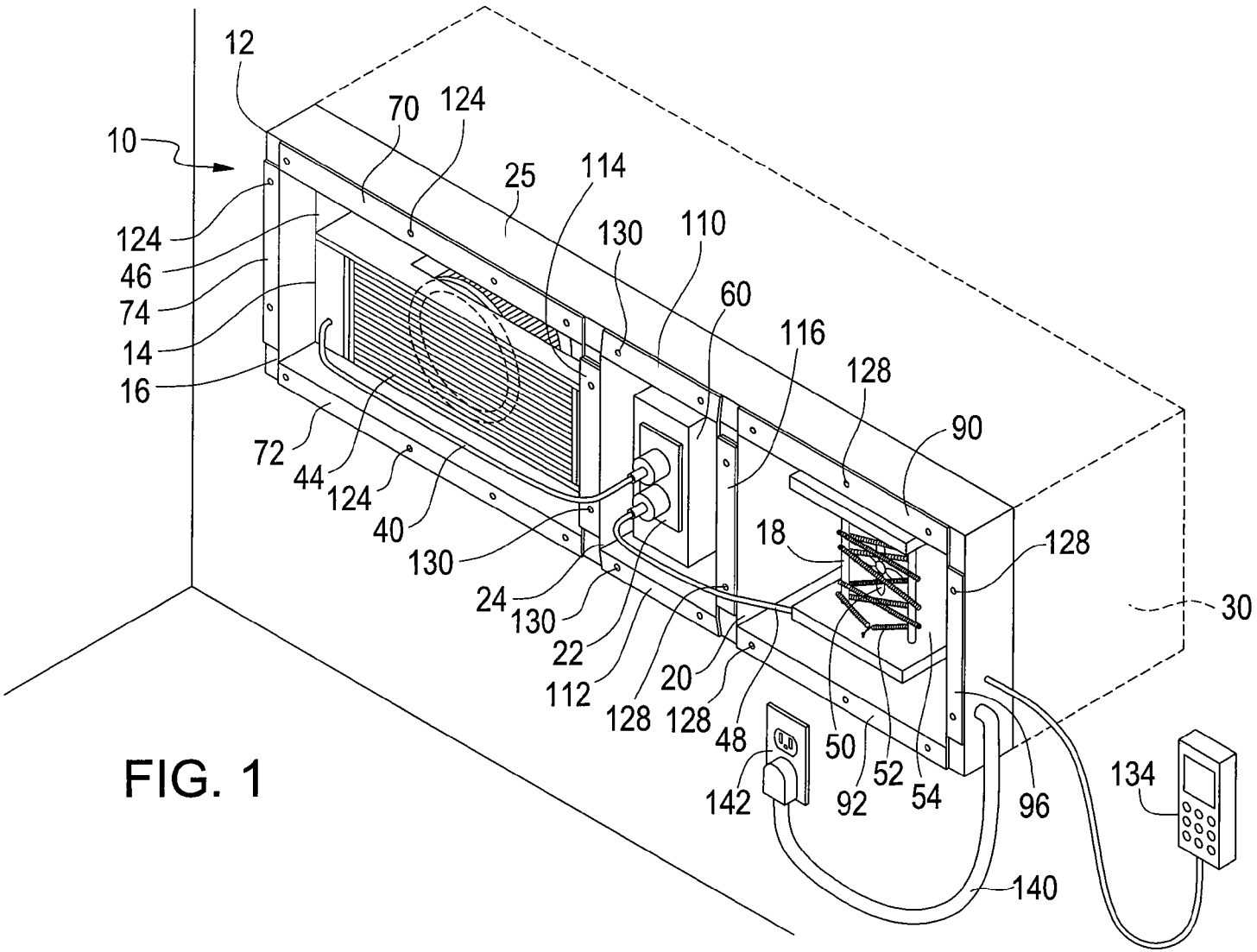
FIG. 1 is a front perspective view of an installed modular heating, ventilating and air conditioning system in accordance with the preferred embodiment of the present invention.

The preferred embodiment of the present invention is illustrated in FIGS. 1-8, where like portions share like numbering. Generally, as illustrated at FIG. 1, an assembled and installed modular heating, ventilating and air conditioning system 10 of the present invention includes a standard through-wall air-conditioning sleeve 12, a standard through-wall air cooling (AC) unit 14 detachably fitted with an adapter collar 16, a heating unit 18 detachably fitted with a heating unit adapter pan 20 and a standard household 110/220 volt electrical outlet 22 detachably fitted with an electrical outlet adapter pan 24. Each of adapter collar 16, heating unit adapter pan 20 and electrical outlet adapter pan 24 are provided so that AC unit 14, heating unit 18 and electrical outlet 22, respectively, can be individually connected within and removed from sleeve. Thus, for example, in the event one of either AC unit 14, heating unit 18 and electrical outlet 22 is damaged, the damaged unit can be easily replaced without having to remove those units that are not damaged.

Figure 3:
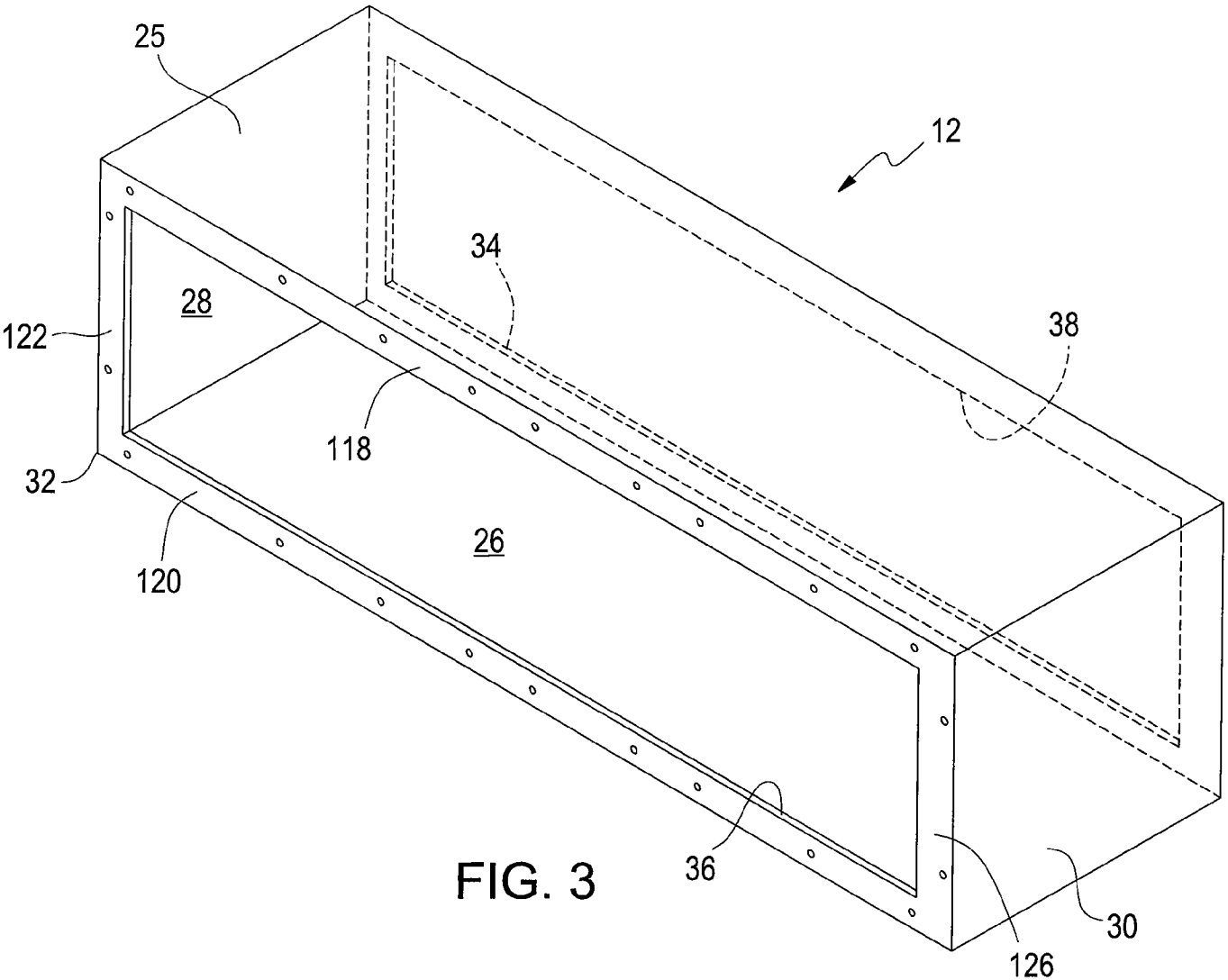
FIG. 3 is a front perspective view of a sleeve of the modular heating, ventilating and air conditioning system of FIG. 1.

More specifically, as illustrated in FIG. 3, sleeve 12 comprises a rectangular structure having a top panel 25, a bottom panel 26, opposing side panels 28 and 30, a front panel 32 and a rear panel 34. As depicted in FIG. 3, each of panels 25, 26, 28, 30, 32 and 34 has a depth sufficient to allow sleeve 12 to be secured within an exterior wall of a building with front panel 32 being exposed to a room in the interior of the building and rear panel 34 being exposed to an exterior of the building. Aligned, rectangular openings 36 and 38 fashioned in front panel 32 and rear panel 34, respectively, form a channel through which air can circulate between the exterior of the building and the interior room of the building.

Detachably secured within opening 36 of front panel 32 are AC unit 14, heating unit 18 and electrical outlet 22. AC unit 14 is a standard through-wall type air cooling unit, for example, the type of unit that is typically located through open windows of apartments and the like for cooling small spaces. Thus, AC unit 14 comprises all the necessary components required for producing cooled air including, among other things, a standard plug and cord 40, a heat exhaust port 42 for blowing heated air from unit 14 to the exterior of a building, a cold exhaust port 44 for blowing cooled air from unit 14 into the interior of a room to be cooled and an AC unit housing 46. Similarly, heating unit 18 comprises all the necessary components required to produce heated air including a standard plug and cord 48, a fan 50 for circulating air, a set of heating coils 52 positioned in front of fan 50 and a heating unit housing 54. Further, electrical outlet 22 comprises a standard 110/220 volt electrical outlet and thus includes, among other things, a first socket 56, a second socket 58 and an electrical outlet housing 60. Sockets 56 and 58 are rendered independently electrifiable by removing the knock-out that would otherwise render them jointly electrifiable. Each of units 14, 18 and 22 are independently, detachably connected within opening 36 as provided for hereafter.

Figure 4:
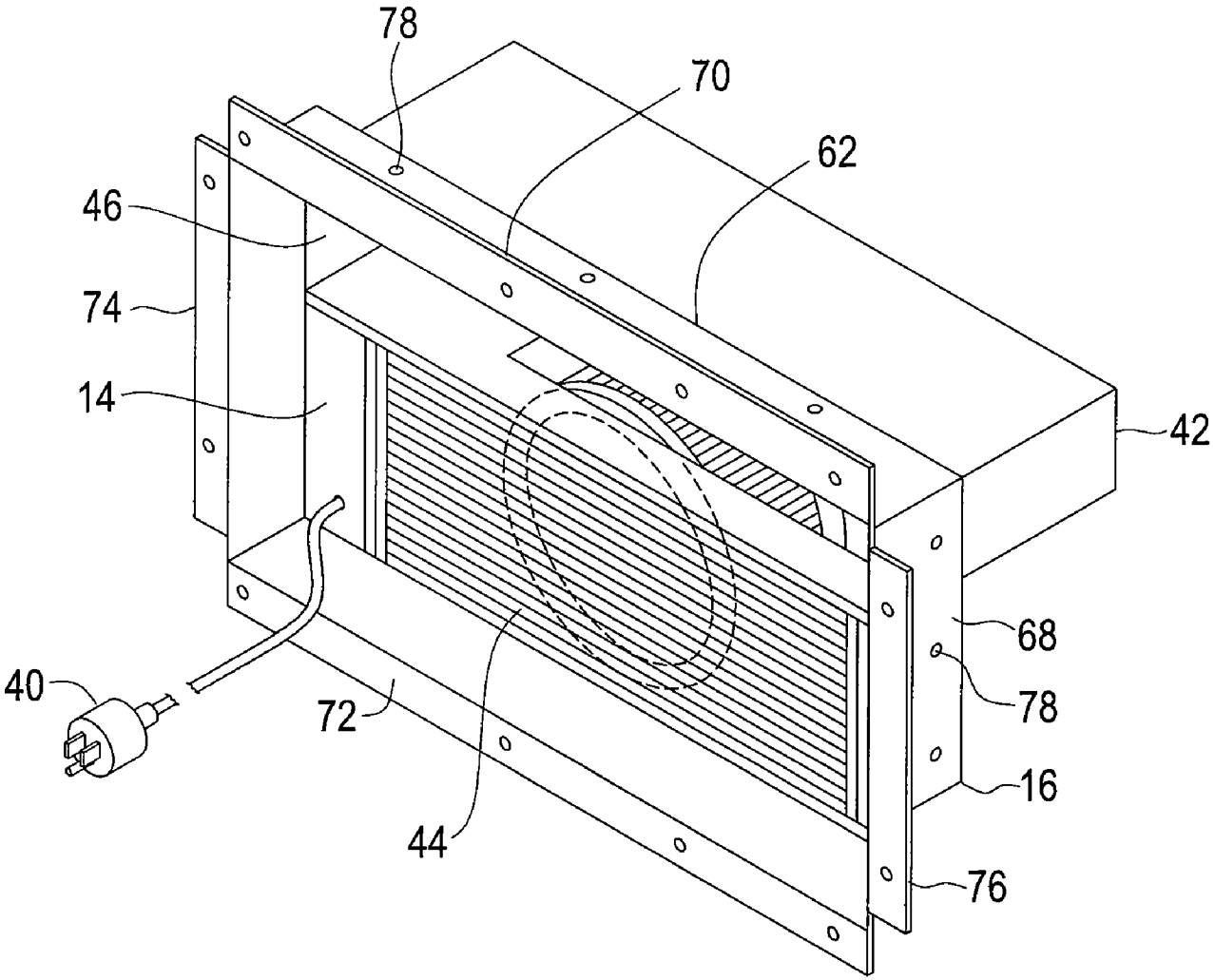
FIG. 4 is a front perspective view of an air conditioning unit and air conditioning adapter collar of the modular heating, ventilating and air conditioning system of FIG. 1.
Figure 5:
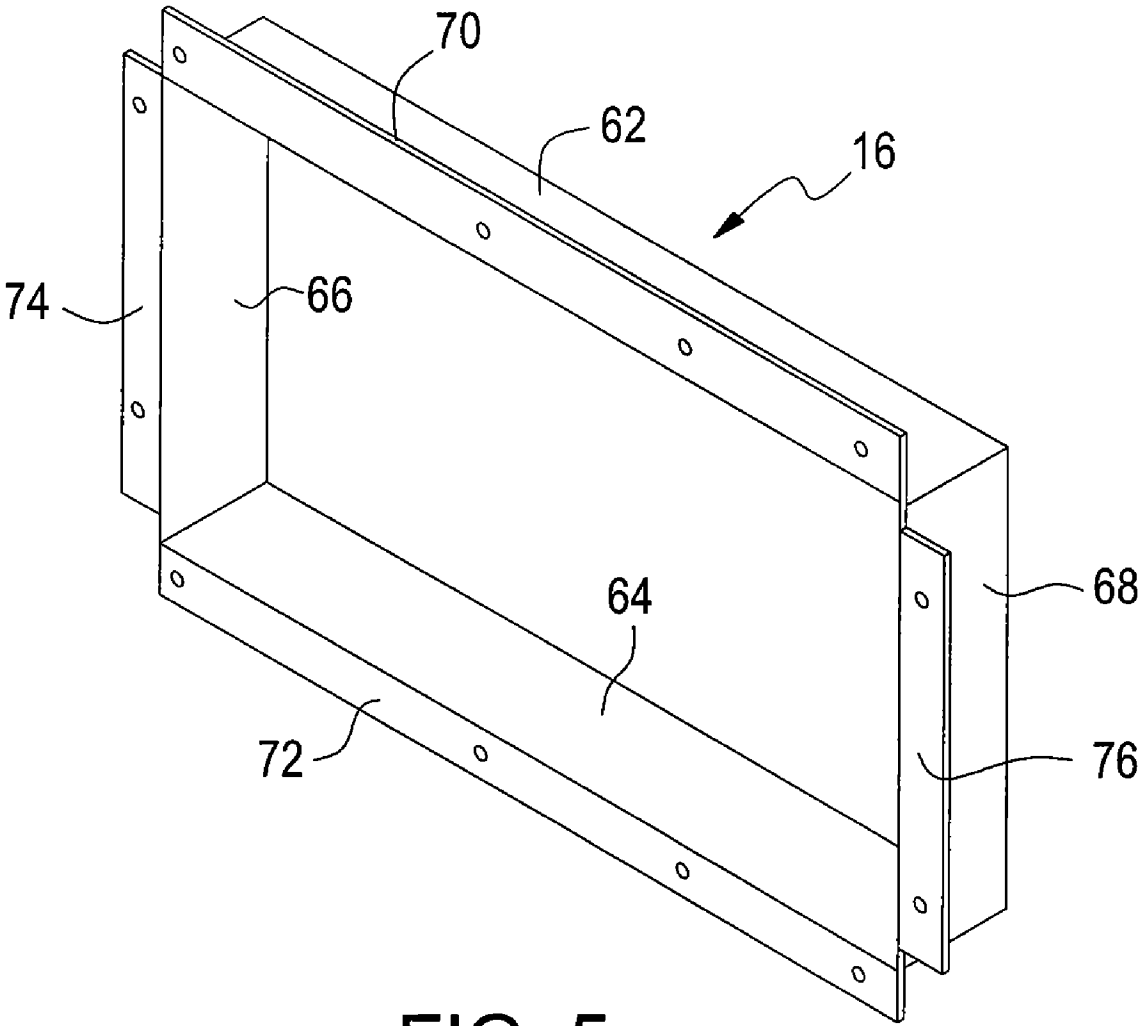
FIG. 5 is a front perspective view of an air conditioning unit adapter collar of the modular heating, ventilating and air conditioning system of FIG. 1.

In order to detachably attach AC unit 14 within opening 36, unit 14 is detachably fitted with adapter collar 16. As illustrated in FIGS. 4 and 5, adapter collar 16 is composed of two pieces including an AC unit connecting piece having an upper section 62, a lower section 64 and opposing lateral sections 66 and 68 and a sleeve connecting piece having an upper flange member 70, a lower flange member 72 and opposing lateral flange members 74 and 76. Flange members 70, 72, 74 and 76 are connected along the edges of sections 62, 64, 66 and 68, respectively, at an angle perpendicular to sections 62, 64, 66 and 68. Adapter collar 16 is positioned about AC unit housing 46 with upper section 62, lower section 64 and opposing lateral sections 66 and 68 being positioned adjacent to the top side, bottom side and lateral sides, respectively, of AC unit 14, with heat exhaust port 42 extending a distance beyond the AC unit connecting piece and cold exhaust port 44 being positioned within adapter collar 16 and behind a plane formed by flange members 70, 72, 74 and 76. Preferably, AC unit 14 is fixed within adapter collar 16 by connecting upper section 62, lower section 64 and opposing lateral sections 66 and 68, respectively, to AC unit housing with screws 78. However, it is anticipated that AC unit 14 can be held within adapter collar 16 by friction fit, hook and pile or any other mean known in the art that would allow AC unit 14 to be detachably connected within adapter collar 16.

Figure 6:
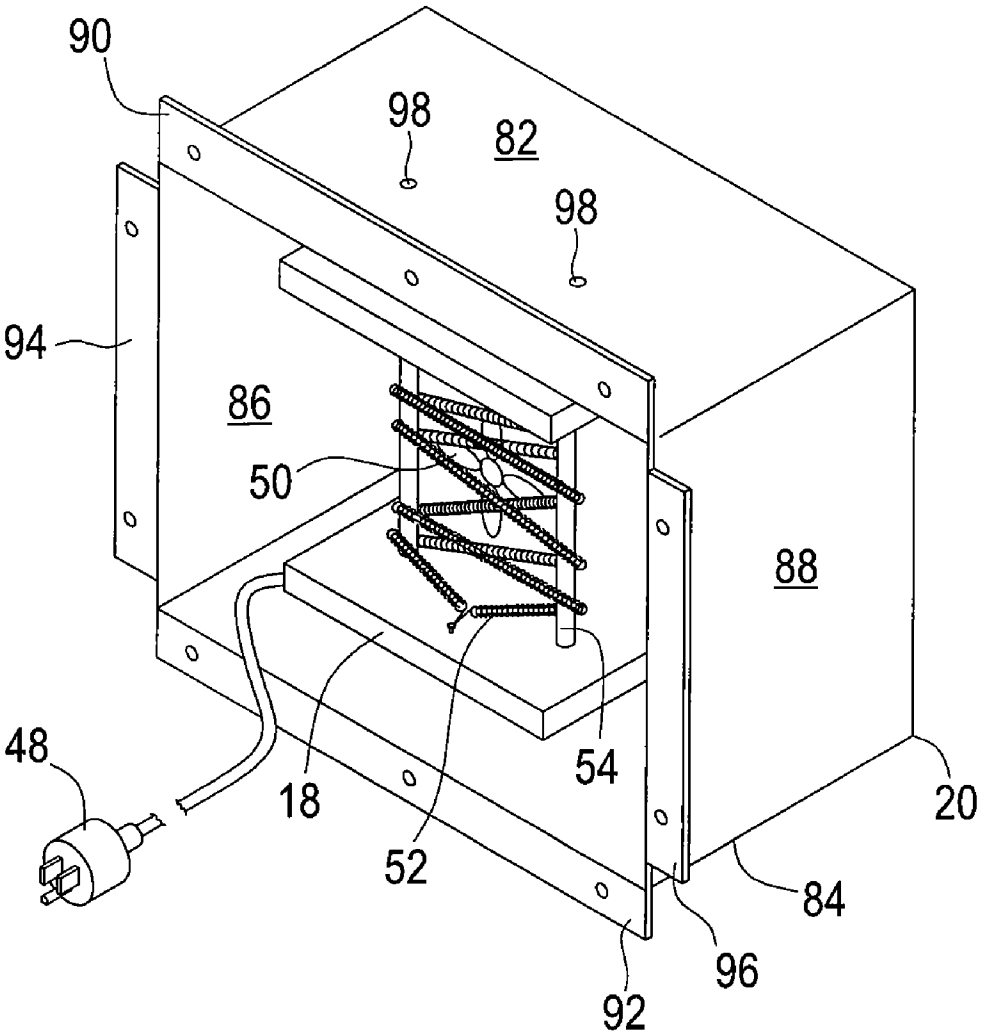
FIG. 6 is a front perspective view of a heating unit and heating unit adapter pan of the modular heating, ventilating and air conditioning system of FIG. 1.

To detachably connect heating unit 18 within opening 36, unit 18 is detachably fitted with heating unit adapter pan 20. As illustrated in FIG. 6 adapter pan 20 is composed of a heating unit connecting piece having an upper section 82, a lower section 84, opposing lateral sections 86 and 88 and a back section connected with sections 82, 84, 86 and 88 to form a pan having an open front and a closed back. In addition, heating unit adapter pan 20 includes a sleeve connecting piece having an upper flange member 90, a lower flange member 92 and opposing lateral flange members 94 and 96. Flange members 90, 92, 94 and 96 are connected along the edges of sections 82, 84, 86 and 88, respectively, at an angle perpendicular to sections 82, 84, 86 and 88. Preferably, heating unit 18 is positioned within heating unit adapter pan 20 with a top portion of heating unit housing 54 connected by screws 98 to upper section 82 of the heating unit connecting piece and with a bottom portion of heating unit housing 54 connected by screws to lower section 84 of the heating unit connecting piece. However, it is anticipated that heating unit 18 can be held within heating unit adapter pan 20 by friction fit, hook and pile or any other mean known in the art that would allow heating unit 18 to be detachably connected within heating unit adapter pan 20.

Figure 7:
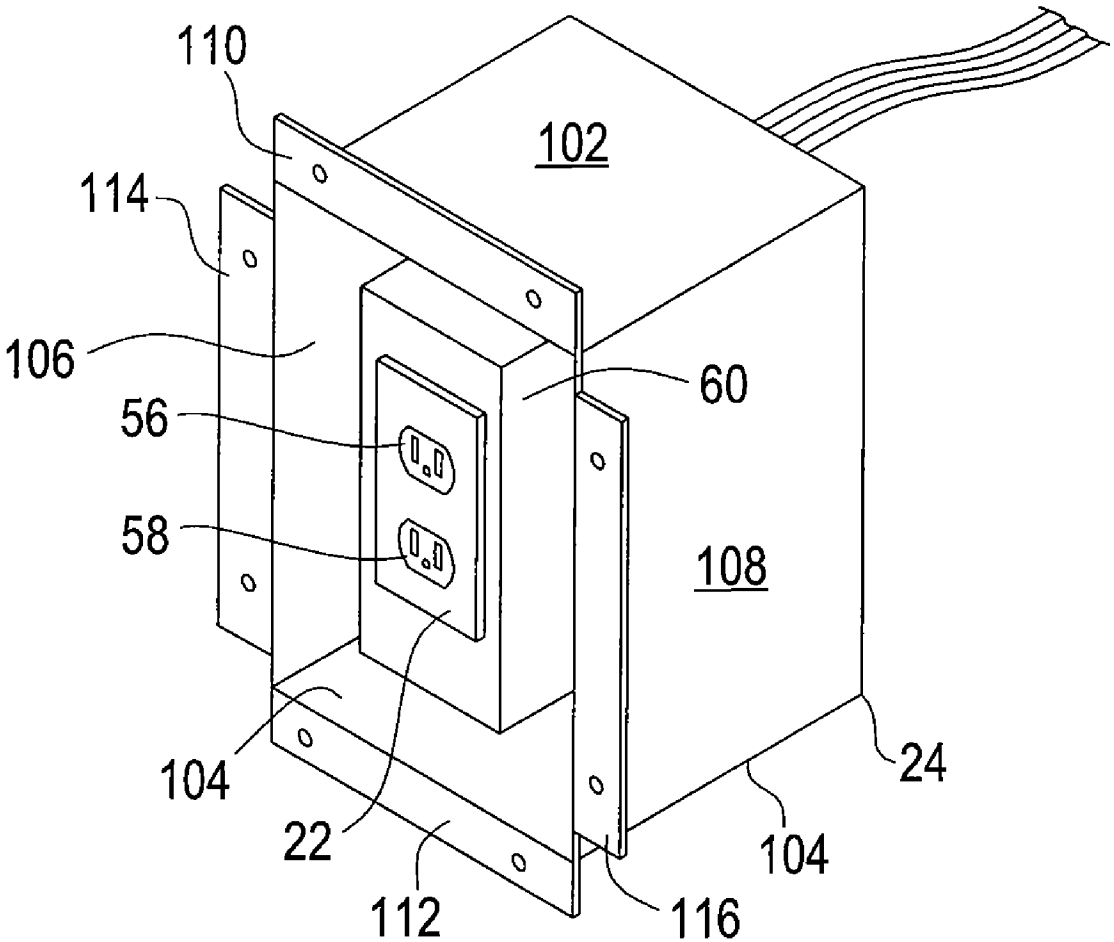
FIG. 7 is a front perspective view of an electrical outlet and electrical outlet adapter pan of the modular heating, ventilating and air conditioning system of FIG. 1.

Likewise, to detachably connect electrical outlet 22 within opening 36, outlet 22 is detachably fitted with electrical outlet adapter pan 24. As illustrated in FIG. 7, adapter pan 24 is composed of an electrical outlet connecting piece having a upper section 102, a lower section 104, opposing lateral sections 106 and 108 and a back section connected with sections 102, 104, 106 and 108 to form a pan having an open front and a closed back. In addition, adaptor pan 24 includes a sleeve connecting piece having an upper flange member 110, a lower flange member 112 and opposing lateral flange members 114 and 116. Flange members 110, 112, 114 and 116 are connected along the edges of sections 102, 104, 106 and 108, respectively, at an angle perpendicular to sections 102, 104, 106 and 108. Preferably, electrical outlet 22 is positioned within electrical outlet adapter pan 24 with a back portion of electrical housing 60 connected by screws to the back section of the electrical outlet connecting piece. However, it is anticipated that electrical outlet 22 can be held within electrical outlet adapter pan 24 by friction fit, hook and pile or any other mean known in the art that would allow electrical outlet 22 to be detachably connected within electrical outlet adapter pan 24.

Figure 2:
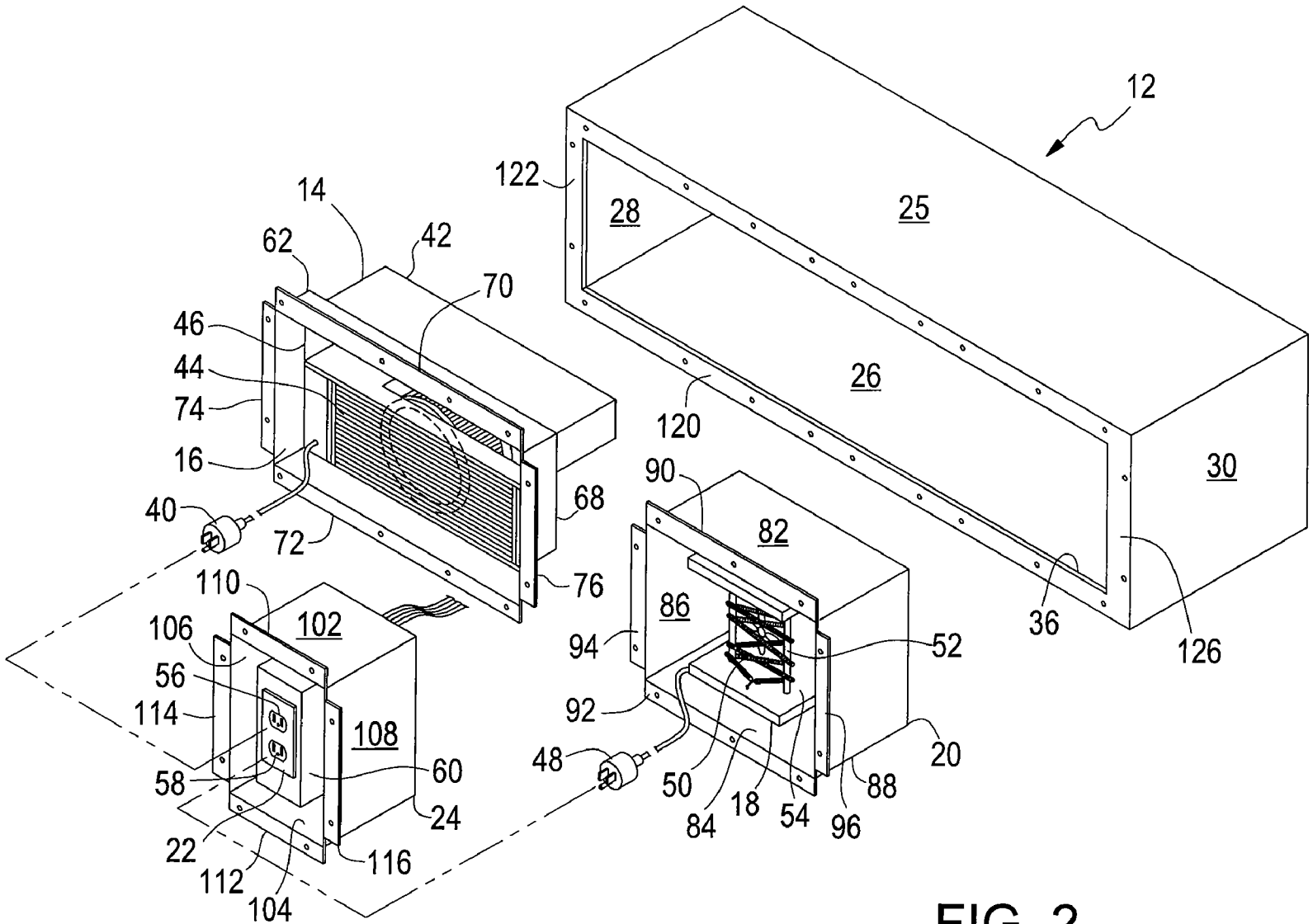
FIG. 2 an exploded view of the modular heating, ventilating and air conditioning system of FIG. 1.

Once fitted with adapter collar 16, heating unit adapter pan 20 and electrical outlet adapter pan 24, AC unit 14, heating unit 18 and electrical outlet 22, respectively, can be detachably connected to front panel 32 within opening 36. More specifically, as illustrated in FIGS. 1, 2 and 3, AC unit 14 with adapter collar 16 connected thereto is maneuvered through opening 36, leading with heat exhaust port 42, until upper flange member 70, lower flange member 72 and opposing lateral flange member 74 of adapter collar 16—contact an upper portion 118, a lower portion 120 and a lateral portion 122, respectively, of front panel 32, where flange members 70, 72 and 74 are subsequently connected by screws 124 to portions 118, 120 and 122. Similarly, heating unit 18 with heating unit adapter pan 20 connected thereto is maneuvered through opening 36, leading with the back section of the heating unit connecting piece, until upper flange member 90, lower flange member 92 and opposing lateral flange member 96 of the sleeve connecting piece of heating unit adapter pan 20—contact upper portion 118, lower portion 120 and another lateral portion 126, respectively, of front panel 32, where flange members 90, 92 and 96 are subsequently connected by screws 128 to portions 118, 120 and 126. In addition, electrical outlet 22 with electrical outlet adapter pan 24 connected thereto is maneuvered through opening 36 between installed AC unit 14 and installed heating unit 18, leading with the back section of the electrical outlet connecting piece, until upper flange member 110, lower flange member 112 and opposing lateral flange members 114 and 116—of the electrical outlet connecting piece contact upper portion 118 of front panel 32, lower portion 120 of front panel 32, opposing lateral flange member 76 of adapter collar 16 of the AC unit and opposing lateral flange member 94 of the sleeve connecting piece of heating unit adapter pan 20, respectively, where flange members 110, 112, 114 and 116 are subsequently connected by screws 130 to portions 118, 120, 76 and 94.

Once secured within opening 36, AC unit 14 and heating unit 18 can be electrical connected with electrical outlet 22. Thus, standard plug and cord 40 of AC unit 14 and plug and cord 48 of heating unit 18 are electrically connected with first socket 56 and second socket 58, respectively, in the conventional manner.

Figure 8:
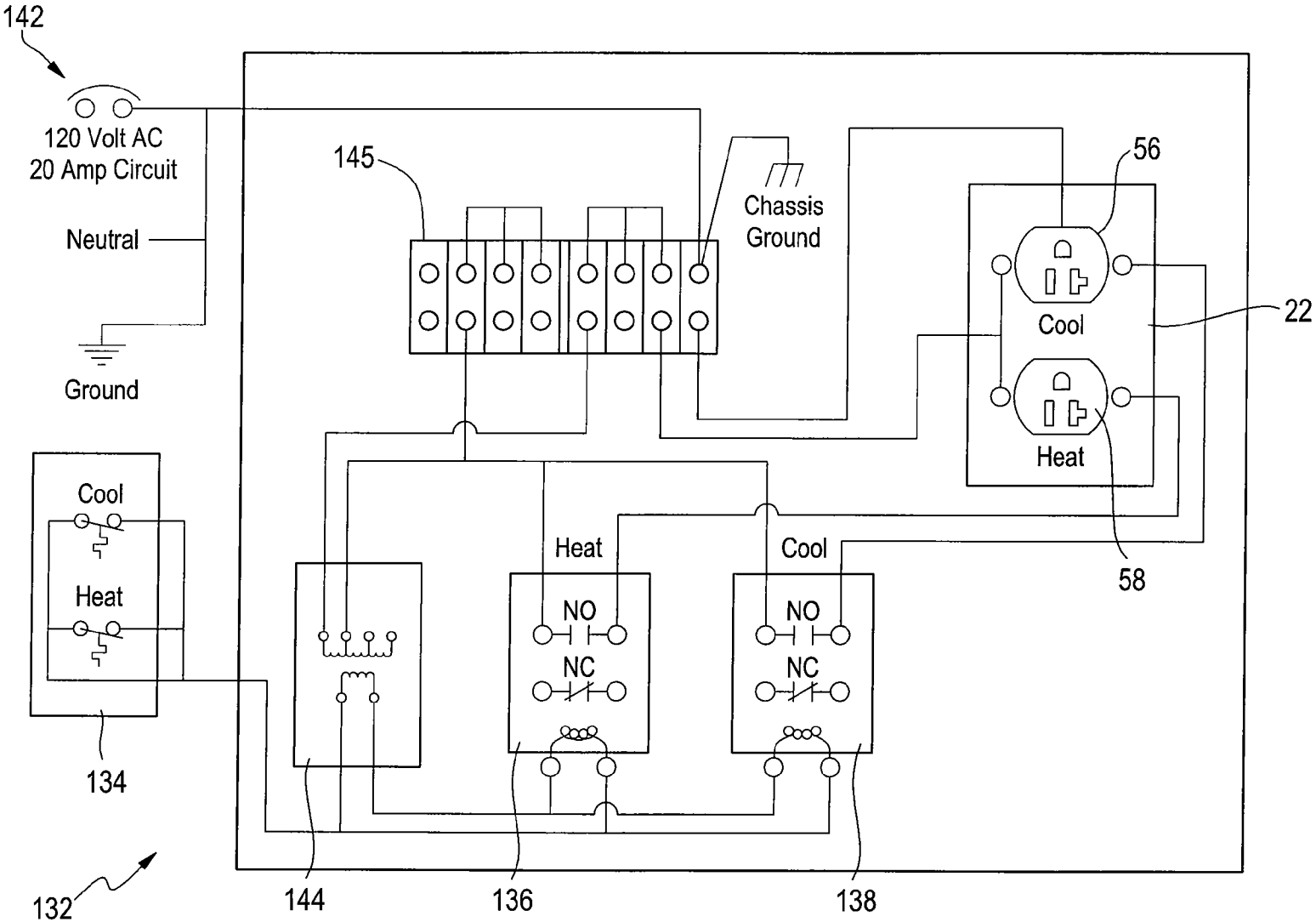
FIG. 8 is a schematic diagram of an electrical control system of the modular heating, ventilating and air conditioning system of FIG. 1.

To selectively activate AC unit 14 and heating unit 18, an electrical control system 132, as depicted in the schematic diagram of FIG. 8, is provided. Control system 132 includes a conventional thermostat and control pad assembly 134 that houses a thermostat and a digital numeric keypad for selecting a desired room temperature. As depicted in FIG. 1, assembly 134 is preferably a flat, rectangular structure that can be fixed to a wall of a room to be cooled and that includes a display for indicating the desired temperature, as well as setting the current temperature of the room. Thermostat and control pad assembly 134 connects with electrical outlet 22 via a wire that enters through an opening in sleeve 12. Control system 132 further includes a first socket switch 136 for electrifying first socket 56 when so directed by assembly 134, a second socket switch 138 for electrifying second socket 58 when so directed by assembly 134, a standard cord and plug 140 for electrically connecting sockets 56 and 58 with a 110/220 volt wall outlet 142, a transformer 144 for stepping down the voltage to the switches from 110/220 volts to 24 volts and a terminal board 145 for electrically interconnecting the various portions of electrical control system 132. Preferably, control system 132 is stored within sleeve 12 behind heating unit adapter pan 20 and electrical outlet adapted pan 24 and communicates with electrical outlet 22 through a hole in the back panel of electrical outlet adapter pan 24.

According to the present invention, an integrated through-wall air conditioning and heating unit can be easily retrofitted with AC unit 14 fitted with adapter collar 16, heating unit 18 fitted with heating unit adapter pan 20 and electrical outlet 22 fitted with electrical outlet adapter pan 24. This includes removing the integrated heating and cooling component from its sleeve, providing electrical outlet 22 detachably fitted with electrical outlet adapter pan 24, providing through-wall AC unit 14 detachably fitted with AC adapter collar 16, providing heater unit 18 detachably fitted with heater unit adapter pan 20 and detachably connecting each of the electrical outlet adapter pan 24, AC adapter collar 16 and heater unit adapter pan 20 within front panel 32 as described above. In addition, the retrofitted through-wall air conditioning and heating unit can be controlled using electrical control system 132, as depicted in the schematic diagram of FIG. 8. Thus, a kit for retrofitting an integrated through-wall air conditioning and heating unit, according to the present invention can include AC unit 14, adapter collar 16, heating unit 18, heating unit adapter pan 20, electrical outlet 22, electrical outlet adapter pan 24 and electrical control system 132.

As will be apparent to one skilled in the art, various modifications can be made within the scope of the aforesaid description. Such modifications being within the ability of one skilled in the art form a part of the present invention and are embraced by the claims below.

It is claimed:

1. A method of retrofitting an integrated through-wall air conditioning and heating unit comprising, providing an integrated through-wall air conditioning and heating unit, the air conditioning and heating unit including a sleeve secured within and through an exterior wall of a building and an integrated heating and cooling component removably secured within the sleeve, the sleeve defining a passageway through the sleeve for moving air between an exterior of the building and the interior of the building, removing the integrated heating and cooling component from the sleeve, providing a 110/220 volt household electrical outlet detachably fitted with an electrical outlet adapter pan, providing a through-wall air conditioning unit detachably fitted with an air conditioning adapter collar, providing a heater unit detachably fitted with a heater unit adapter pan, and detachably connecting the electrical outlet adapter pan, the air conditioning adapter collar and the heater unit adapter pan within the passageway, wherein each of the electrical outlet, the air conditioning unit and the heater unit is independently removable from the passageway.

2. The method according to claim 1 wherein the integrated heating and cooling component is damaged.

3. The method according to claim 1 wherein the electrical outlet adapter pan includes an open front, a closed back, a continuous sidewall extending between the open front and closed back and a flange extending along a length of an edge of the continuous sidewall, the flange being adapted and arranged for detachably engaging the sleeve.

4. The method according to claim 1 wherein the heater unit adapter pan includes an open front, a closed back, a continuous sidewall extending between the open front and closed back and a flange extending along a length of an edge of the continuous sidewall, the flange being adapted and arranged for detachably engaging the sleeve.

5. The method according to claim 1 wherein the air conditioning adapter collar includes an open front, an open back, a continuous sidewall extending between the open front and open back and a flange extending along a length of an edge of the continuous sidewall, the flange being adapted and arranged for detachably engaging the sleeve.

6. The method according to claim 1 further comprising detachably, electrically connecting the through-wall air conditioning unit to a first socket of the electrical outlet with an air conditioning unit cord and plug assembly and detachably, electrically connecting the heater unit to a second socket of the electrical outlet with a heater unit cord and plug assembly wherein the first socket and the second socket are independently, selectively activated.

7. The method according to claim 6 further comprising electrically connecting an electrical system control module to the electrical outlet for independently activating one of the first socket and the second socket, the system control module including a thermostat and control pad assembly electrically connected with a first switch and a second switch, wherein the first switch selectively activates the first socket upon direction by the thermostat and control pad assembly and the second switch selectively activates the second socket.

8. The method according to claim 6 wherein a cord of the heater unit cord and plug assembly extends through an opening in a closed back of the heater unit adapter pan.

9. The method according to claim 1 further comprising replacing the electrical outlet without removing one or more of the air conditioning unit and the heater unit.

10. The method according to claim 1 further comprising replacing the air conditioning unit without removing one or more of the electrical outlet and the heater unit.

11. The method according to claim 1 further comprising replacing the heater unit without removing one or more of the electrical outlet and the air conditioning unit.

* * * * *